United States Patent [19]

Clearman et al.

[11] Patent Number: 4,989,619

[45] Date of Patent: Feb. 5, 1991

[54] SMOKING ARTICLE WITH IMPROVED FUEL ELEMENT

[75] Inventors: Jack F. Clearman, Blakely, Ga.; James L. Resce, Yadkinville, N.C.; Ernest G. Farrier, Winston-Salem, N.C.; Alan B. Norman; Olivia P. Furin, both of Clemmons, N.C.; William C. Squires, Winston-Salem, N.C.

[73] Assignee: R. J. Reynolds Tobacco Company, Winston-Salem, N.C.

[21] Appl. No.: 939,592

[22] Filed: Dec. 9, 1986

Related U.S. Application Data

[63] Continuation-in-part of Ser. No. 769,532, Aug. 26, 1985.

[51] Int. Cl.[5] ..... A24D 1/00; A24D 1/18

[52] U.S. Cl. ..... 131/194; 131/195; 131/359; 131/369

[58] Field of Search ..... 131/194, 195, 359, 369

[56] References Cited

U.S. PATENT DOCUMENTS

| | | |
|---|---|---|
| 29,436 | 7/1860 | Lindsley . |
| 235,886 | 12/1880 | Lindsley . |
| 261,056 | 7/1882 | Smith . |
| 275,420 | 7/1883 | Swiss . |
| 1,529,181 | 7/1922 | Holmes . |
| 2,098,619 | 11/1937 | Finnell . |
| 2,907,686 | 10/1959 | Siegel . |
| 3,200,819 | 4/1963 | Gilbert . |
| 3,223,090 | 12/1965 | Strubel . |
| 3,258,015 | 6/1966 | Ellis . |
| 3,356,094 | 12/1967 | Ellis . |
| 3,516,417 | 6/1970 | Moses . |
| 3,738,374 | 6/1973 | Bennett . |

(List continued on next page.)

FOREIGN PATENT DOCUMENTS

| | | |
|---|---|---|
| 276250 | 9/1966 | Australia . |
| 117355 | 12/1983 | European Pat. Off. . |
| 174645 | 9/1985 | European Pat. Off. . |
| 370692 | 11/1906 | France . |
| 998556 | 11/1945 | France . |

(List continued on next page.)

OTHER PUBLICATIONS

Certain Materials submitted to the Senate Committee on Commerce by Mr. Herbert A. Gilbert in Sep. of 1967.

(List continued on next page.)

*Primary Examiner*—V. Millin

*Attorney, Agent, or Firm*—Grover M. Myers; David G. Conlin

[57] ABSTRACT

The present invention preferably relates to a smoking article which is capable of producing substantial quantities of aerosol, both initially and over the useful life of the product, without significant thermal degradation of the aerosol former and without the presence of substantial pyrolysis or incomplete combustion products or sidestream aerosol.

The article of the present invention is able to provide the user with the sensations and benefits of cigarette smoking without the substantial combustion products produced by burning tobacco in a conventional cigarette. In addition, the article may be made virtually ashless so that the user does not have to remove any ash during use.

Preferred embodiments of the present smoking article comprise a short combustible carbonaceous fuel element, a heat stable, preferably particulate alumina, substrate bearing an aerosol forming substance, an efficient insulating means, and a relatively long mouthend piece.

The fuel element is provided with a plurality of peripheral passageways i.e., passageways on the outer surface of the fuel element and/or just beneath the surface of the fuel element, which provides heat transfer from the burning fuel element to the aerosol generating means while reducing levels of carbon monoxide in the aerosol generated and delivered to the user.

85 Claims, 1 Drawing Sheet

U.S. PATENT DOCUMENTS

| | | |
|---|---|---|
| 3,773,053 | 11/1973 | Stephens, Jr. . |
| 3,863,644 | 2/1975 | Hunt . |
| 3,943,941 | 3/1976 | Boyd . |
| 4,044,777 | 8/1977 | Boyd . |
| 4,079,742 | 3/1978 | Ranier . |
| 4,284,089 | 8/1981 | Ray . |
| 4,286,604 | 9/1981 | Ehretsmann . |
| 4,326,544 | 4/1982 | Hardwick . |
| 4,340,072 | 7/1982 | Bolt . |
| 4,347,855 | 9/1982 | Lanzillotti . |
| 4,391,285 | 7/1983 | Burnett . |
| 4,407,308 | 10/1983 | Baker . |
| 4,474,191 | 10/1984 | Steiner . |
| 4,481,958 | 11/1984 | Rainer . |
| 4,553,556 | 11/1985 | Lephardt . |
| 4,596,258 | 6/1986 | Steiner . |

FOREIGN PATENT DOCUMENTS

| | | |
|---|---|---|
| 1264962 | 8/1960 | France . |
| 2033749 | 11/1970 | France . |
| 2057421 | 4/1971 | France . |
| 2057422 | 4/1971 | France . |
| 23237 | 7/1986 | Iran . |
| 13985/3890 | 9/1985 | Liberia . |
| 1185887 | 6/1967 | United Kingdom . |
| 1431045 | 7/1973 | United Kingdom . |

OTHER PUBLICATIONS

A copy of the newpapers article which was reproduced in the AAP materials.

Guinness Book of World Records, pp. 242–243 (1985 Edition).

Guinness Book of World Records, p. 194 (1966 Edition).

Ames et al., Mut. Res. 31:347–364 (1975).

Nago et al., Mut. Res., 42:355 (1977).

Langes Handbook of Chemistry, 10, 272–274 (11th ed., 1973).

Guinness Book of World Records, pp. 242–243 (1985 Edition).

Guinness Book of World Records, p. 194 (1966 Edition).

Hackhs Chemical Dictionary, 34, (4th ed., 1969).

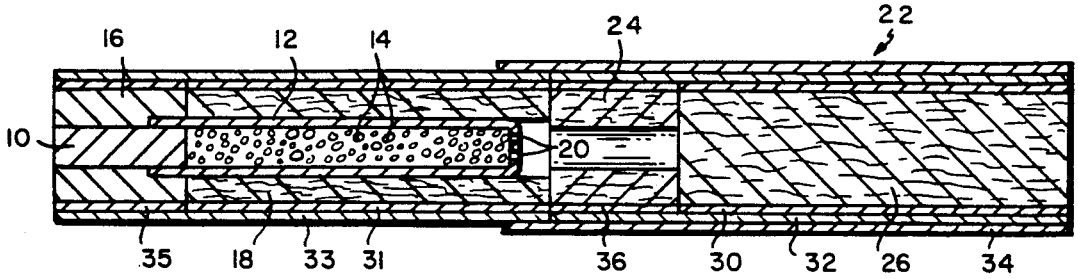
FIG. 1
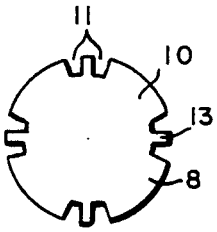
FIG. 2
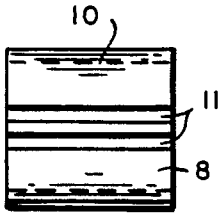
FIG. 2A
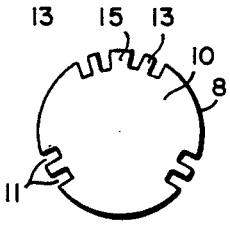
FIG. 3
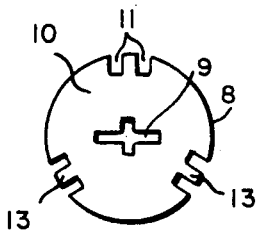
FIG. 4
FIG. 5
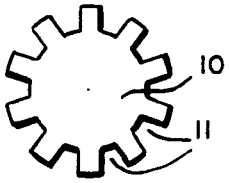
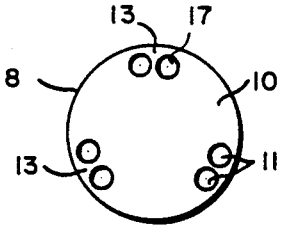
FIG. 6
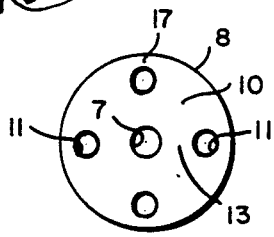
FIG. 7
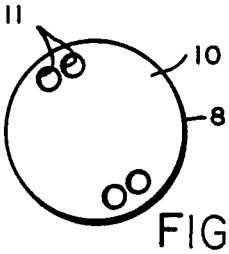
FIG. 8
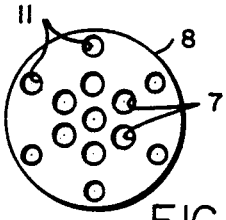
FIG. 9
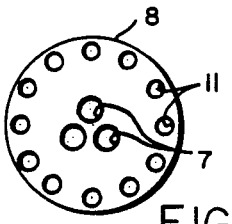
FIG. 10
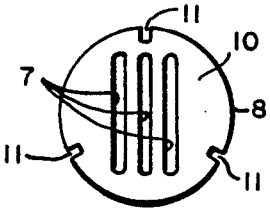
FIG. 11

SMOKING ARTICLE WITH IMPROVED FUEL ELEMENT

This application is a continuation-in-part of U.S. application Ser. No. 769,532, filed Aug. 26, 1985.

BACKGROUND OF THE INVENTION

The present invention relates to a smoking article which produces an aerosol that resembles tobacco smoke and which preferably contains no more than a minimal amount of incomplete combustion or pyrolysis products.

Many smoking articles have been proposed through the years, especially over the last 20 to 30 years. Many of these articles employ tobacco substitutes. Tobacco substitutes have been made from a wide variety of treated and untreated plant material, such as cornstalks, eucalyptus leaves, lettuce leaves, corn leaves, cornsilk, alfalfa, and the like. Numerous patents teach proposed tobacco substitutes made by modifying cellulosic materials, such as by oxidation, by heat treatment, or by the addition of materials to modify the properties of cellulose. One of the most complete lists of these substitutes is found in U.S. Pat. No. 4,079,742 to Rainer et al. Despite these extensive efforts, it is believed that none of these products has been found to be completely satisfactory as a tobacco substitute.

Many proposed smoking articles have been based on the generation of an aerosol or a vapor. Some of these products purportedly produce an aerosol or a vapor without heat. See, e.g., U.S. Pat. No. 4,284,089 to Ray. However, the aerosols or vapors from those articles fail to adequately simulate tobacco smoke.

Some proposed aerosol generating smoking articles have used a heat or fuel element in order to produce an aerosol.

One of the earliest of these proposed articles was described by Siegel in U.S. Pat. No. 2,907,686. Siegel proposed a cigarette substitute which included an absorbent carbon fuel, preferably a 2½ inch (63.5 mm) stick of charcoal, which was burnable to produce hot gases, and a flavoring agent carried by the fuel, which was adapted to be distilled off incident to the production of the hot gases. Siegel also proposed that a separate carrier could be used for the flavoring agent, such as a clay, and that a smoke-forming agent, such as glycerol, could be admixed with the flavoring agent. Siegel's proposed cigarette substitute would be coated with a concentrated sugar solution to provide an impervious coat and to force the hot gases and flavoring agents to flow toward the mouth of the user. It is believed that the presence of the flavoring and/or smoke-forming agents in the fuel of Siegel's article would cause substantial thermal degradation of those agents and an attendant off-taste. Moreover, it is believed that the article would tend to produce substantial sidestream smoke containing the aforementioned unpleasant thermal degradation products.

Another such article was described by Ellis et al. in U.S. Pat. No. 3,258,015. Ellis et al. proposed a smoking article which had an outer cylinder of fuel having good smoldering characteristics, preferably fine cut tobacco or reconstituted tobacco, surrounding a metal tube containing tobacco, reconstituted tobacco, or other source of nicotine and water vapor. On smoking, the burning fuel heated the nicotine source material to cause the release of nicotine vapor and potentially aerosol generating material, including water vapor. This was mixed with heated air which entered the open end of the tube. A substantial disadvantage of this article was the ultimate protrusion of the metal tube as the tobacco fuel was consumed. Other apparent disadvantages of this proposed smoking article include the presence of substantial tobacco pyrolysis products, the substantial tobacco sidestream smoke and ash, and the possible pyrolysis of the nicotine source material in the metal tube.

In U.S. Pat. No. 3,356,094, Ellis et al. modified their original design to eliminate the protruding metal tube. This new design employed a tube made out of a material, such as certain inorganic salts or an epoxy bonded ceramic, which became frangible upon heating. This frangible tube was then removed when the smoker eliminated ash from the end of the article. Even though the appearance of the article was very similar to a conventional cigarette, apparently no commercial product was ever marketed. See also, British Pat. No. 1,185,887 to Synectics which discloses similar articles.

In U.S. Pat. No. 3,738,374, Bennett proposed the use of carbon or graphite fibers, mat, or cloth associated with an oxidizing agent as a substitute cigarette filler. Flavor was provided by the incorporation of a flavor or fragrance into the mouthend of an optional filter tip.

U.S. Pat. Nos. 3,943,941 and 4,044,777 to Boyd et al. and British Pat. No. 1,431,045 to Gallaher proposed the use of a fibrous carbon fuel which was mixed or impregnated with volatile solids or liquids which were capable of distilling or subliming into the smoke stream to provide "smoke" to be inhaled upon burning of the fuel. Among the enumerated smoke producing agents were polyhydric alcohols, such as propylene glycol, glycerol, and 1,3-butylene glycol, and glyceryl esters, such as triacetin. Despite Boyd et al.'s desire that the volatile materials distill without chemical change, it is believed that the mixture of these materials with the fuel would lead to substantial thermal decomposition of the volatile materials and to bitter off tastes. Similar products were proposed in U.S. Pat. No. 4,286,604 to Ehretsmann et al. and in U.S. Pat. No, 4,326,544 to Hardwick et al.

Bolt et al., in U.S. Pat. No. 4,340,072 proposed a smoking article having a fuel rod with a central air passageway and a mouthend chamber containing an aerosol forming agent. The fuel rod preferably was a molding or extrusion of reconstituted tobacco and/or tobacco substitute, although the patent also proposed the use of tobacco, a mixture of tobacco substitute material and carbon, or a sodium carboxymethylcellulose (SCMC) and carbon mixture. The aerosol forming agent was proposed to be a nicotine source material, or granules or microcapsules of a flavorant in triacetin or benzyl benzoate. Upon burning, air entered the air passage where it was mixed with combustion gases from the burning rod. The flow of these hot gases reportedly ruptured the granules or microcapsules to release the volatile material. This material reportedly formed an aerosol and/or was transferred into the mainstream aerosol. It is believed that the articles of Bolt et al., due in part to the long fuel rod, would produce insufficient aerosol from the aerosol former to be acceptable, especially in the early puffs. The use of microcapsules or granules would further impair aerosol delivery because of the heat needed to rupture the wall material. Moreover, total aerosol delivery would appear dependent on the use of tobacco or tobacco substitute materials, which would provide substantial pyrolysis products and sidestream smoke which would not be desirable in this type smoking article.

U.S. Pat. No. 3,516,417 to Moses proposed a smoking article, with a tobacco fuel, which was substantially the same as the article of Bolt et al., except that Moses used a double density plug of tobacco in lieu of the granular or microencapsulated flavorant of Bolt et al. See FIG. 4, and col. 4, lines, 17–35. Similar tobacco fuel articles are described in U.S. Pat. No. 4,347,855 to Lanzillotti et al. and in U.S. Pat. No. 4,391,285 to Burnett et al. European Paten Appln. No. 117,355, to Hearn, describes silimar smoking articles having a pyrolyzed ligno-cellulosic heat source having an axial passageway therein. These articles would suffer many of the same problems as the articles proposed by Bolt et al.

Steiner, in U.S. Pat. No. 4,474,191 describes "smoking devices" containing an air-intake channel which, except during the lighting of the device, is completely isolated from the combustion chamber by a fire resistant wall. To assist in the lighting of the device, Steiner provides means for allowing the brief, temporary passage of air between the combustion chamber and the air-intake channel. Steiner's heat conductive wall also serves as a deposition area for nicotine and other volatile or sublimable tobacco simulating substances In one embodiment (FIGS. 9 and 10), the device is provided with a hard, heat transmitting envelope. Materials reported to be useful for this envelope include ceramics, graphite, metals, etc. In another embodiment, Steiner envisions the replacement of his tobacco (or other combustible material) fuel element with some purified cellulose-based product in an open cell configuration, mixed with activated charcoal. This material, when impregnated with an aromatic substance is stated to dispense a smoke-free, tobacco-like aroma. Similarly, see also, Steiner, U.S. Pat. No. 4,569,258.

As far as the present inventors are aware, none of the foregoing smoking articles or tobacco substitutes have ever achieved any commercial success, and it is believed that none has ever been widely marketed. The absence of such smoking articles from the marketplace is believed to be due to a variety of reasons, including insufficient aerosol generation, both initially and over the life of the product, poor taste, off-taste due to the thermal degradation of the smoke former and/or flavor agents, the presence of substantial pyrolysis products and sidestream smoke, and unsightly appearance.

Thus, despite decades of interest and effort, there is still no smoking article on the market which provides the sensations associated with conventional cigarette smoking, without delivering considerable quantities of incomplete combustion and pyrolysis products.

In late 1985, a series of foreign patents were granted or registered disclosing novel smoking articles capable of providing the benefits and advantages associated with conventional cigarette smoking, without delivering appreciable quantities of incomplete combustion or pyrolysis products. The earliest of these patents was Liberian Pat. No. 13985/3890, issued Sept. 13, 1985. This patent corresponds to a later published European Patent Publication, No. 174,645, published Mar. 19, 1986.

SUMMARY OF THE INVENTION

The present invention relates to a fuel element for a smoking article and to a smoking article utilizing this new fuel element which is capable of producing substantial quantities of aerosol, both initially and over the useful life of the product, preferably without significant thermal degradation of the aerosol former and without the presence of substantial pyrolysis or incomplete combustion products or sidestream smoke. Preferred articles of the present invention are capable of providing the user with the sensations of cigarette smoking without the necessity of burning tobacco.

The fuel element of the present invention, which is preferably employed in an elongated, cigarette-type smoking article, comprises a short, i.e., less than about 30 mm long, preferably less than about 20 mm long, preferably carbonaceous material having a plurality of longitudinal passageways situated in, or proximate to the periphery of, the fuel element and preferably extending completely longitudinally therethrough. The fuel element is preferably employed in conjunction with a physically separate aerosol generating means having one or more aerosol forming materials. This aerosol generating means is most preferably in a conductive heat exchange relationship with the fuel element.

As used herein the "peripheral passageways" may take either or both of two general forms, namely:

(1) open channels extending longitudinally along the periphery of the fuel element, preferably running from end to end, or (2) longitudinal holes situated near the longitudinal periphery of the fuel element, preferably extending from end to end, which preferably burn-out toward at least a portion of the periphery of the fuel element, forming open channels during the burning of the fuel element.

The holes and/or channels can have any convenient cross-sectional shape. Most conveniently the holes are circular in shape and the channels are rectangular or essentially rectangular in shape for ease of manufacturing. However, other cross-sectional shapes may be used.

In one preferred embodiment of the present invention, the fuel element has a plurality of open channels in a configuration which comprises two or more sets of adjacent channels (or grooves) cut into the periphery of the fuel element, preferably extending from the lighting end to the non-lighting end thereof. (See, e.g., FIGS. 2–5).

In another preferred embodiment of the present invention, the fuel element is provided with at least two peripheral passageways in a configuration which comprises longitudinally extending holes situated proximate to the peripheral longitudinal edge of the fuel element, preferably extending from the lighting end to the non-lighting end thereof Preferably, these longitudinal holes are situated near the periphery of the fuel element such that as the fuel is consumed at its peripheral edge, the holes open up (i.e., burn-out) to form open channels (See, e g., FIGS. 6–8).

In many of these preferred embodiments, several channels and/or peripheral holes may be located closely together so that they can coalesce into a larger passageway during the burning of the fuel element.

Most preferably, the fuel element is provided with a combination of peripheral passageways and one or more central passageways. As used herein, central passageways are longitudinally extending holes which, due to their position in the fuel element, do not burn-out to the peripheral edge during use. When more than one centrally situated passageway is employed, it may be advantageous for these passageways to coalesce during the burning of the fuel element. (See, e.g., FIGS. 9 and 10). When central passageways are present, it has been discovered that carbon monoxide (CO) levels resulting from the burning of the fuel element can be reduced by baking-out the fuel element after formation. This bake-out procedure is generally conducted at elevated temperatures, e.g., from about 750° C. to 1000° C., preferably from about 850° C. to 950° C., for several hours.

In the most preferred embodiments, the non-lighting end of the fuel element is encircled by a heat conducting member. Generally, due to the heat sink nature of this member, that portion of the fuel element separating the channels and/or that portion of the periphery of the fuel element that would otherwise be consumed during burning, does not burn beyond the point of contact with the heat conducting member.

It has been discovered that the use of peripheral passageways in fuel elements for cigarette-type smoking articles, does reduce the level of CO formed and delivered to the user during smoking when compared to fuel similar elements that do not have such peripheral passageways. In preferred embodiments of the present invention, the total CO delivered during smoking (as measured by non-dispersive infra-red analysis) is generally about 15 mg or less, preferably about 9 mg or less, most preferably about 7 mg or less, for about 10 puffs under FTC smoking conditions (infra).

The peripheral passageway configurations of the present invention also help to improve the ease of lighting, thereby providing more user satisfaction with the smoking article. In addition, the presence of such passageways in the fuel element have been found to enhance early aerosol delivery (e.g., in puffs 1–4).

The present invention also provides the user with an aesthetic benefit. In cigarette-type smoking articles utilizing the fuel element of the present invention (see e.g., FIG. 1), the outer paper wrapper surrounding the fuel element typically burns rapidly forming a pleasant grey ash coating. This ash serves two purposes; (1) it acts as an indicator to the user that the article is ignited and (2) the porous nature of the ash promotes the burning of the fuel element by allowing oxygen easy access thereto.

It has further been discovered that the addition of peripheral passages to a dense fuel element (i.e., with a density of at least 0.5 g/cc) will improve its lighting and burning characteristics in smoking articles.

The fuel elements of this invention are generally less than about 30 mm in length, preferably less than about 20 mm in length, and most preferably less than about from 10 to 15 mm in length. The diameter of the fuel elements may range from about 2 to 8 mm, preferably from about 4 to 6 mm. To support combustion over the desired puff count of from about 8 to 12 puffs under FTC smoking conditions, the fuel elements preferably have a density of at least about 0.7 g/cc, more preferably at least about 0.85 g/cc, as determined e.g., by mercury intrusion.

The fuel element and the physically separate aerosol generating means are preferably arranged in a conductive heat exchange relationship. This conductive heat exchange relationship is preferably achieved by providing a heat conducting member, such as a metal conductor, which efficiently conducts or transfers heat from the burning fuel element to the aerosol generating means.

This heat conducting member preferably contacts the fuel element and the aerosol generating means around at least a portion of their peripheral surfaces, and it may form the container for the aerosol forming materials. Preferably, the heat conducting member is recessed from the lighting end of the article, advantageously by at least about 3 mm or more, preferably by at least 5 mm or more, to avoid interfering with the lighting and burning of the fuel element and to avoid any protrusion of the heat conducting member after the fuel element is consumed.

In addition, at least a part of the fuel element is preferably provided with a peripheral insulating member, such as a jacket of insulating fibers, the jacket being preferably resilient and at least 0.5 mm thick, which reduces radial heat loss and assists in retaining and directing heat from the fuel element toward the aerosol generating means and may aid in reducing any fire causing propensity of the fuel element. The insulating member also preferably and advantageously overwraps at least part of the aerosol generating means, and thus helps simulate the feel of a conventional cigarette.

Smoking articles of the type described herein are particularly advantageous because the hot, burning fire cone is always close to the aerosol generating means, which maximizes heat transfer thereto and maximizes the resultant production of aerosol, especially in embodiments which are provided with a heat conducting and/or insulating member. In addition, because the aerosol forming substance is physically separate from the fuel element, it is exposed to substantially lower temperatures than are present in the burning fire cone, thereby minimizing the possibility of thermal degradation of the aerosol former.

The smoking article of the present invention is normally provided with a mouthend piece including means, such as a longitudinal passageway, for delivering the aerosol produced by the aerosol generating means to the user. Advantageously, the cigarette-type smoking article has the same overall dimensions as a conventional cigarette, and as a result, the mouthend piece and the aerosol delivery means usually extend about one-half or more of the length of the article. Alternatively, the fuel element and the aerosol generating means may be produced without a built-in mouthend piece or aerosol delivery means, for use as a separate disposable cartridge with a disposable or reusable mouthend piece, e.g., a cigarette holder.

The smoking article of the present invention may also include a charge of tobacco which is used to add tobacco flavors to the aerosol. Advantageously, the tobacco may be placed at the mouthend of, or around the periphery of, the aerosol generating means, and/or it may be mixed with the carrier for the aerosol forming substance. Other substances, such as flavoring agents, may be incorporated into the aerosol generating means in a similar manner. In some embodiments, a tobacco charge may be used as the carrier for the aerosol forming substance. Tobacco or a tobacco extract flavor may alternatively, or additionally, be incorporated in the fuel element to provide additional tobacco flavor.

Preferred embodiments of this invention are capable of delivering at least 0.6 mg of aerosol, measured as wet total particulate matter (WTPM), in the first 3 puffs, when smoked under FTC smoking conditions, which consist of a 35 ml puff volume of two seconds duration, separated by 58 seconds of smolder. More preferably, embodiments of the invention are capable of delivering 1.5 mg or more of aerosol in the first 3 puffs. Most preferably, embodiments of the invention are capable of delivering 3 mg or more of aerosol in the first 3 puffs when smoked under FTC smoking conditions. Moreover, preferred embodiments of the invention deliver an average of at least about 0.8 mg of WTPM per puff for at least about 6 puffs, preferably at least about 10 puffs, under FTC smoking conditions.

In addition to the aforementioned capabilities, preferred smoking articles of the present invention are capable of providing an aerosol which is chemically simple, consisting essentially of air, oxides of carbon, water, aerosol former including any desired flavors or other desired volatile materials, and trace amounts of other materials. This aerosol has no significant mutagenic activity as measured by the Ames test. In addition, preferred articles may be made virtually ashless, so that the user does not have to remove any ash during use.

As used herein, and only for the purposes of this application, "aerosol" is defined to include vapors, gases, particles, and the like, both visible and invisible, and especially those components perceived by the user to be "smoke-like", generated by action of the heat from the burning fuel element upon substances contained within the aerosol generating means, or elsewhere in the article. As so defined, the term "aerosol" includes volatile flavoring agents and/or pharmacologically or physiologically active agents, irrespective of whether they produce a visible aerosol.

As used herein, the phrase "conductive heat exchange relationship" is defined as a physical arrangement of the aerosol generating means and the fuel element whereby heat is transferred by conduction from the burning fuel element to the aerosol generating means substantially throughout the burning period of the fuel element. Conductive heat exchange relationships can be achieved by placing the aerosol generating means in contact with the fuel element and thus in close proximity to the burning portion of the fuel element, and/or by utilizing a conductive member to transfer heat from the burning fuel to the aerosol generating means. Preferably both methods of providing conductive heat transfer are used.

As used herein, the term "carbonaceous" means primarily comprising carbon.

As used herein, the term "insulating member" applies to all materials which act primarily as heat insulators when used in smoking articles in accord with this invention. Preferably, these materials do not burn during use, but they may include slow burning carbons and like materials, as well as materials which fuse during use, such as low temperature grades of glass fibers. Suitable insulators have a thermal conductivity in g-cal/(sec)($cm^2$)(°C./cm), of less than about 0.05, preferably less than about 0.02, most preferably less than about 0.005, See, Hackh's *Chemical Dictionary* 672 (4th ed., 1969) and Lange's *Handbook of Chemistry* 10, 272–274 (11th ed., 1973).

The preferred smoking articles of the present invention are described in greater detail in the accompanying drawings and in the detailed description of the invention which follow.

BRIEF DESCRIPTION OF THE DRAWINGS

FIG. 1 is a longitudinal view of one preferred smoking article utilizing the improved fuel element of the present invention.

FIGS. 2–10 illustrate, from the lighting end, several of the preferred fuel element passageway configurations of the present invention.

FIG. 2A is a longitudinal view of the fuel element shown in FIG. 2.

FIG. 11 illustrates, from the lighting end, another possible fuel element passageway configuration useful herein.

DETAILED DESCRIPTION OF THE PREFERRED EMBODIMENTS

FIG. 1 illustrates a cigarette-type smoking article which advantageously utilizes the preferred carbonaceous fuel element 10 of the present invention.

The periphery 8 of fuel element 10 is encircled by a resilient jacket of insulating fibers 16, such as glass fibers.

Overlapping a portion of the mouth end of the fuel element 10 is a metallic capsule 12 which contains an aerosol generating means including a substrate material 14 bearing one or more aerosol forming substances (e.g., polyhydric alcohols such as glycerin or propylene glycol).

Capsule 12 is surrounded by a jacket of tobacco 18. Two slit-like passageways 20 are provided at the mouth end of the capsule in the center of the crimped tube.

At the mouth end of tobacco jacket 18 is a mouthend piece 22 comprising an annular section of cellulose acetate 24 and a segment of rolled, non-woven polypropylene scrim. The article, or portions thereof, is overwrapped with one or more layers of cigarette papers 30–36.

FIG. 2 illustrates a preferred fuel element passageway configuration of the present invention. In this embodiment, the periphery 8 of fuel element 10 is provided with four sets of adjacent channels or grooves 11, each set situated on the periphery and spaced about 90° apart. Within each set, the adjacent channels are spaced from one other by a small ridge of carbon 13.

During the burning of the fuel element of FIG. 2, or similar fuel elements, the small ridge of carbon 13, gradually burns-out (up to the point of contact with the conductive capsule 12) and the two channels coalesce into one larger channel. The resulting burnt fuel element (for FIG. 2) has four equally spaced large channels extending from the lighting end to the point of insertion into capsule 12.

Fuel elements of this type allow greater air dilution of the aerosol delivered to the user, thus reducing the effective amount of carbon monoxide delivered. Fuel elements of this type also transfer heat very quickly to the aerosol generating means, thereby assisting in high early aerosol delivery.

In the embodiment of FIG. 3, the fuel element 10 is provided with four sets of adjacent channels 11, each situated on the periphery 8 thereof, two sets of which are located proximate to one another, and two sets of which are each located about 120° from the larger carbon ridge 15 separating the two proximate sets.

In the case of the two proximate sets of channels, the large ridge 15, which separates the two groups, begins to burn-out slowly (i.e., only after several puffs have been taken). In contrast, within each set, the small ridge of carbon 13, which separates the adjacent channels, burns out rapidly such that the two channels coalesce into one larger channel. As in the previously described embodiment, the ridges generally burn away only up to the point of contact with the capsule 12.

In the embodiment of FIG. 4, the fuel element 10 is provided with three sets of adjacent channels 11, each set situated on the periphery 8 thereof, spaced about 120° apart. Within each set, the adjacent channels are spaced from one other by a small ridge of carbon 13, such that during the burning of the fuel element, the two channels coalesce into one larger channel (up to the point of contact with the capsule). The resulting burning fuel element has three equally spaced large channels running from the lighting end to the exposed portion of the non-lighting end.

The FIG. 4 fuel element also includes a central passageway 9, in the shape of a cross, which runs from the lighting end to the non-lighting end of the fuel element. Fuel elements having this passageway configuration light very quickly and provide low CO levels.

As illustrated in FIGS. 2–4, the open channel embodiments may vary in size, number, and position on the periphery of the fuel element. In general, the channels useful herein range in depth from about 0.005 in. (0.13 mm) to about 0.10 in. (2.5 mm), preferably from about 0.010 in. (0.25 mm) to about 0.050 in. (1.3 mm), most preferably from about 0.025 in. (0.62 mm) to about 0.035 in. (0.88 mm).

The width of each channel may vary from about 0.005 in. (0.13 mm) to about 0.05 in. (1.3 mm), preferably from about 0.010 in. (0.25 mm) to about 0.025 in. (0.64 mm), most preferably from about 0.014 in. (0.35 mm) to about 0.020 in. (0.50 mm).

The space separating adjacent channels may vary from about 0.012 in. (0.3 mm) to about 0.040 in. (1.0 mm), preferably from about 0.015 in. (0.38 mm) to about 0.030 in. (0.76 mm), most preferably from about 0.020 in. (0.51 mm) to 0.025 in. (0.64 mm). When two sets of adjacent channels are proximate (e.g., in FIG. 3) the large ridge is generally about twice the size of the ridge separating the adjacent channels.

In the embodiment of FIG. 5, the fuel element 10 is provided with a series of ten evenly spaced channels 11, each set situated on the periphery 8 thereof. During the burning of this fuel element, the ridge of fuel separating each channel (with the exception of the portion inserted in the capsule) gradually burns away, providing increased air flow and corresponding air dilution to the aerosol stream.

The other types of preferred embodiments of the present invention are illustrated in FIGS. 6–10. These fuel elements are provided with at least two longitudinally extending holes proximate to the periphery of the fuel element. In preferred embodiments of this type, the fuel element is also provided with at least one centrally located longitudinally extending passageway. In these fuel elements, the peripheral holes preferably burn-out to form open channels during the burning of the fuel element (at least at the lighting end thereof). This burn-out feature is governed both by the size (i.e., diameter) and the proximity of the peripheral holes to the periphery of the fuel element (outer web thickness).

The diameter of these holes may range from about 0.015 in. (0.38 mm) to about 0.045 in. (1.14 mm), preferably from about 0.020 in. (0.51 mm) to about 0.040 in. (1.0 mm), most preferably from about 0.025 in. (0.64 mm) to about 0.039 in. (0.99 mm).

In general, it has been discovered that an outer web thickness of less than about 0.025 in. (0.62 mm), preferably less than about 0.015 in. (0.38 mm), more preferably less than about 0.010 in. (0.25 mm), and most preferably less than about 0.006 in. (0.15 mm) provide the desired burning characteristics and low CO levels.

In the embodiment of FIG. 6, the fuel element 10 is provided with three sets of adjacent longitudinal holes 11, each set situated near the periphery 8 thereof, spaced about 120° apart. Within each set, the adjacent longitudinal holes are spaced from one another by a small amount of carbon 13, which burns out during the burning of the fuel element allowing the adjacent holes to coalesce In addition, the outer web 17 of the fuel element has such a small thickness that the longitudinal holes also burn rapidly through the periphery of the fuel element, forming large open channels. Fuel elements having this type of peripheral passageway configuration also light very quickly and provide low CO levels.

In the embodiment of FIG. 7, the fuel element 10 is provided with four longitudinally extending holes 11, each located near the periphery 8 thereof and spaced about 90° apart. The fuel element is also provided with one centrally located longitudinal hole 7. In the most preferred embodiments of this type of fuel element, the portion of fuel 13 between the peripheral holes 11 and the central hole 7 (i.e., the inner web) and the portion of fuel 17 extending from the peripheral holes 11 to the periphery 8 of the fuel element (i.e., the outer web) are approximately the same.

During the burning of this fuel element, the outer web 17 rapidly burns away, leaving four open channels running along the peripheral surface of the fuel element, up to the point of contact with the capsule, i.e., "the non-inserted" length of the fuel element.

In the embodiment of FIG. 8, the fuel element 10 is provided with two sets of adjacent longitudinal holes 11, each set situated near the periphery 8 thereof spaced about 180° apart. Within each set, the adjacent longitudinal holes are spaced from one other by a small amount of carbon 13, such that during the burning of the fuel element, the adjacent holes coalesce. Also, the holes are spaced from the periphery of the fuel element by an amount of carbon 17, so that the holes rapidly burn through the outer web to the periphery to form a single large channel. Fuel elements having this peripheral passageway configuration light quickly and provide low CO levels.

The embodiment of FIG. 9 represents the currently most preferred peripheral passageway configuration of the present invention. As illustrated, in this embodiment the fuel element is provided with seven large central holes 7, arranged as shown, i.e., with one central hole and six hexagonally situated central holes. The fuel element is further provided with six smaller longitudinally extending peripheral holes 11, each spaced about half the distance between the periphery 8 of the fuel element and each of the six outer central holes 11.

During the burning of this fuel element, the space between the small peripheral holes 11 and the periphery 8 of the fuel element slowly burns away, ultimately affording up to six channels running the non-inserted length of the fuel element. In addition, the carbon between the seven central holes 7 burns out rapidly, providing one large central hole. Fuel elements having this passageway configuration light quickly and provide lower CO levels than similar fuel elements without peripheral holes.

In the embodiment of FIG. 10, the fuel element is provided with twelve longitudinally extending peripheral holes 11 each spaced about half the distance between the periphery 8 of the fuel element and the outer edge of the three triangularly arranged central holes 7.

During the burning of this fuel element, the space between the outer holes 11 and the periphery 8 of the fuel element slowly burns away, ultimately affording twelve channels running the non-inserted length of the fuel element. In addition, the carbon between the central holes 7 burns out rapidly, providing one large central passageway. Fuel elements having this passageway configuration also light quickly and provide lower CO levels than similar fuel elements without peripheral passageways.

FIG. 11 illustrates another fuel element passageway configuration useful in the smoking articles of FIG. 1. As illustrated, the fuel element 10 is provided with three narrow central passageways 7 and three equally spaced channels 11 on the periphery. Fuel elements of this type light rapidly and deliver good aerosol and low CO.

Upon lighting the fuel element of this invention burns, generating the heat used to volatilize the aerosol forming substance or substances in the aerosol generating means. Because the preferred fuel element is relatively short, the hot, burning fire cone is always close to the aerosol generating means. This proximity to the burning fire cone, together with the plurality of peripheral passageways in the fuel element, which increases the rate of burning, helps to transfer heat from the burning fuel element to the aerosol generating means.

Heat transfer to the aerosol generating means preferably transfers enough heat to produce sufficient aerosol without degrading the aerosol former.

Heat transfer can be aided by the use of a heat conducting member, such as a metallic foil or a metallic enclosure for the aerosol generating means, which contacts or couples the fuel element and the aerosol generating means. Preferably, this member is recessed, i.e., spaced from, the lighting end of the fuel element, by at least about 3 mm, preferably by at least about 5 mm or more, to avoid interference with the lighting and burning of the fuel element and to avoid any protrusion after the fuel element is consumed.

Heat transfer may also be aided by the use of an insulating member as a peripheral overwrap over at least a part of the fuel element, and advantageously over at least a part of the aerosol generating means. Such an insulating member aids in good aerosol production by retaining and directing much of the heat generated by the burning fuel element toward the aerosol generating means.

Because the aerosol forming substance in preferred embodiments is physically separate from the fuel element, and because the number, arrangement, or configuration of passageways (or a combination thereof) in the fuel element allow for the controlled transfer of heat from the burning fuel element to the aerosol generating means, the aerosol forming substance is exposed to substantially lower temperatures than are generated by the burning fuel, thereby minimizing the possibility of its thermal degradation. This also results in aerosol production almost exclusively during puffing, with little or no aerosol production during smolder. In addition, the use of a carbonaceous fuel element eliminates the presence of substantial pyrolysis or incomplete combustion products and the presence of substantial sidestream aerosol.

Because of the small size and burning characteristics of the preferred fuel elements employed in the present invention, the fuel element usually begins to burn over substantially all of its exposed length within a few puffs. Thus, that portion of the fuel element adjacent to the aerosol generator becomes hot quickly, which significantly increases heat transfer to the aerosol generator, especially during the early and middle puffs.

Heat transfer, and therefore aerosol delivery, is especially enhanced by the presence of a plurality of passageways in the fuel element which allow the rapid passage of hot gases to the aerosol generator, especially during puffing. Because the preferred fuel element is relatively short, there is no long section of nonburning fuel to act as a heat sink, as was common in previous thermal aerosol articles.

In the preferred embodiments of the invention, the short carbonaceous fuel element, heat conducting member, insulating means, and passages in the fuel cooperate with the aerosol generator to provide a system which is capable of producing substantial quantities of aerosol, on virtually every puff. The close proximity of the fire cone to the aerosol generator after a few puffs, together with the insulating means, results in high heat delivery both during puffing and during the relatively long period of smolder between puffs.

In general, the combustible fuel elements which may be employed in practicing some embodiments of the invention normally have a diameter no larger than that of a conventional cigarette (i.e., less than or equal to about 8 mm), and are generally less than about 30 mm long. Advantageously the fuel element is about 15 mm or less in length, preferably about 10 mm or less in length. Advantageously, the diameter of the fuel element is between about 2 to 8 mm, preferably about 4 to 6 mm.

Alternatively, other geometrical cross sectional shapes (other than circular) may be employed in the fuel elements described herein if desired, for example, square, rectangular, oval, and the like. In these cases, the values used above for the diameter refer to the maximum cross-sectional dimension, which in any event would preferably still remain about 8 mm. Thus, the maximum cross-sectional area for the lighting end of any fuel element herein would be about 64 $mm^2$.

The density of the fuel elements employed herein is generally from about 0.7 g/cc to about 1.5 g/cc. Preferably the density is greater than 0.7 g/cc, more preferably greater than about 0.85 g/cc.

The preferred material used for the formation of fuel elements is carbon. Preferably, the carbon content of these fuel elements is at least 60 to 70%, most preferably about 80% or more, by weight. High carbon content fuel elements are preferred because they produce minimal pyrolysis and incomplete combustion products, little or no visible sidestream smoke, minimal ash, and have high heat capacity. However, lower carbon content fuel elements are also within the scope of this invention. For example, fuel elements having about 50 to 60% by weight carbon, especially where a minor amount of tobacco, tobacco extract, or a nonburning inert filler can be used.

Also, although not preferred, other fuel materials may be employed, such as molded or extruded tobacco, reconstituted tobacco, tobacco substitutes and the like, provided that they generate and provide sufficient heat to the aerosol generating means to produce the desired level of aerosol from the aerosol forming material, as discussed above. The density of the fuel used should preferably be above about 0.7 g/cc., more preferably above about 0.85 g/cc., which is higher than the densities normally used in conventional smoking articles. Where such other materials are used, it is much preferred to include carbon in the fuel, preferably in amounts of at least about 20 to 40% by weight, more preferably at least about 50% by weight, and most preferably at least about 65 to 70% by weight, the balance being the other fuel components, including any binder, burn modifiers, moisture, etc.

The carbonaceous materials used in or as the preferred fuel element may be derived from virtually any of the numerous carbon sources known to those skilled in the art. Preferably, the carbonaceous material is obtained by the pyrolysis or carbonization of cellulosic materials, such as wood, cotton, rayon, tobacco, coconut, paper, and the like, although carbonaceous materials from other sources may be used.

In most instances, the carbonaceous fuel elements should be capable of being ignited by a conventional cigarette lighter without the use of an oxidizing agent. Burning characteristics of this type may generally be obtained from a cellulosic material which has been pyrolyzed at temperatures between about 400° C. to about 1100° C., preferably between about 500° C. to about 950° C., most preferably at about 750° C., in an inert atmosphere or under a vacuum. The pyrolysis time is not believed to be critical, as long as the temperature at the center of the pyrolyzed mass has reached the aforesaid temperature range for at least a few, e.g., about 15, minutes. A slow pyrolysis, employing gradually increasing temperatures over many hours, is believed to produce a uniform material with a high carbon yield. Preferably, the pyrolyzed material is then cooled (to less than about 35° C.), ground to a fine powder (mesh size of about minus 200), and heated in an inert gas stream at a temperature up to about 850° C. to remove any remaining volatiles prior to further processing.

A preferred carbonaceous fuel element is a pressed or extruded mass of carbon prepared from a powdered carbon and a binder, by conventional pressure forming or extrusion techniques. A preferred non-activated carbon for fuel elements is prepared from pyrolized paper, such as a non-talc grade of Grande Prairie Canadian Kraft, available from the Buckeye Cellulose Corporation of Memphis, Tenn. A preferred activated carbon for such a fuel element is PCB-G, and another preferred non-activated carbon is PXC, both available from Calgon Carbon Corporation, Pittsburgh, Pa.

The binders which may be used in preparing such a fuel element are well known in the art. A preferred binder is sodium carboxymethylcellulose (SCMC), which may be used alone, which is preferred, or in conjunction with materials such as sodium chloride, vermiculite, bentonite, calcium carbonate, and the like. An especially preferred grade of SCMC binder is available from the Hercules Chemical Co., under the designation 7HF. Other useful binders include gums, such as guar gum, and other cellulose derivatives, such as methylcellulose and carboxymethylcellulose (CMC).

A wide range of binder concentrations can be utilized. Preferably, the amount of binder is limited to minimize contribution of the binder to undesirable combustion products. On the other hand, sufficient binder should be included to hold the fuel element together during manufacture and use. The amount used will thus depend on the cohesiveness of the carbon in the fuel.

In general, an extruded carbonaceous fuel may be prepared by admixing from about 50 to 99 weight percent, preferably about 80 to 95 weight percent, of the carbonaceous material, with from 1 to 50 weight percent, preferably about 5 to 20 weight percent of the binder, with sufficient water to make a paste having a stiff dough-like consistency. Minor amounts, e.g., up to about 35 weight percent, preferably about 10 to 20 weight percent, of tobacco, tobacco extract, and the like, may be added to the paste with additional water, if necessary, to maintain a stiff dough consistency. The dough is then extruded using a standard ram or piston type extruder into the desired shape, optionally with the desired channels and/or passageways, and dried, preferably at about 95° C. to reduce the moisture content to about 2 to 7 percent by weight. Alternatively, or additionally, the passageways or channels may be formed using conventional drilling or cutting techniques, respectively.

In certain preferred embodiments, the carbon/binder fuel elements are pyrolyzed in an inert atmosphere after formation, for example, at from about 750° C. to 1150° C., preferably from about 850° C. to 950° C., for several hours, to convert the binder to carbon and thereby form a virtually 100% carbon fuel element.

Fuel elements "baked out" under these conditions generally deliver lower CO levels than non-baked fuel elements, but may in turn be harder to ignite. Baked-out fuel elements having the peripheral passageway configurations of the present invention also show lower CO delivery levels, but are not perceptibly any more difficult to ignite than their non-baked counterparts.

The fuel elements of the present invention also may contain one or more additives to improve burning characteristics, such as up to about 5, preferably from about 1 to 2, weight percent of potassium carbonate. Additives to improve physical characteristics, such as clays like kaolins, serpentines, attapulgites and the like also may be used.

While undesirable in most cases, carbonaceous materials which require the use of an oxidizing agent to render them ignitable by a cigarette lighter are within the scope of this invention, as are carbonaceous materials which require the use of a glow retardant or other type of combustion modifying agent. Such combustion modifying agents are disclosed in many patents and publications and are well known to those of ordinary skill in the art.

In certain preferred embodiments, the carbonaceous fuel elements are substantially free of volatile organic material. By that, it is meant that the fuel element is not purposely impregnated or mixed with substantial amounts of volatile organic materials, such as volatile aerosol forming or flavoring agents, which could degrade in the burning fuel. However, small amounts of materials, e.g., water, which are naturally adsorbed by the carbon in the fuel element, may be present therein. Similarly, small amounts of aerosol forming substances may migrate from the aerosol generating means and thus may also be present in the fuel.

In other preferred embodiments, the fuel element may contain tobacco, tobacco extracts, and/or other materials, primarily to add flavor to the aerosol. Amounts of these additives may range up to about 25 weight percent or more, depending upon the additive, the fuel element, and the desired burning characteristics. Tobacco and/or tobacco extracts may be added to carbonaceous fuel elements e.g., at about 10 to 20 weight percent, thereby providing tobacco flavors to the mainstream and tobacco aroma to the sidestream akin to a conventional cigarette, without generally affecting the Ames test activity of the product.

The aerosol generating means used in practicing this invention is physically separate from the fuel element. By physically separate it is meant that the substrate, container, or chamber which contains the aerosol forming materials is not mixed with, or a part of, the fuel element. This arrangement helps reduce or eliminate thermal degradation of the aerosol forming substance and the presence of sidestream smoke. While not a part of the fuel element, the aerosol generating means preferably abuts, is connected to, or is otherwise adjacent to the fuel element so that the fuel and the aerosol generating means are in a conductive heat exchange relationship. Preferably, the conductive heat exchange relationship is achieved by providing a heat conductive member, such as a metal foil, recessed from the lighting end of the fuel element, which efficiently conducts or transfers heat from the burning fuel element to the aerosol generating means.

The aerosol generating means is preferably spaced no more than 15 mm from the lighting end of the fuel element. The container for the aerosol generating means may vary in length from about 2 mm to about 60 mm, preferably from about 5 mm to 40 mm, and most preferably from about 20 mm to 35 mm. The diameter of the container for the aerosol generating means may vary from about 2 mm to about 8 mm, preferably from about 3 to 6 mm. As with the fuel element, alternative geometric shapes may be employed if so desired. Thus the diameter values given herein would apply to the maximum cross-sectional dimension of the selected shape.

Preferably, the aerosol generating means includes one or more thermally stable materials which carry one or more aerosol forming substances. As used herein, a "thermally stable" material is one capable of withstanding the high, albeit controlled, temperatures, e.g., from about 400° C. to about 600° C., which may eventually exist near the fuel, without significant decomposition or burning. The use of such material is believed to help maintain the simple "smoke" chemistry of the aerosol, as evidenced by a lack of Ames test activity in the preferred embodiments. While not preferred, other aerosol generating means, such as heat rupturable microcapsules, or solid aerosol forming substances, are within the scope of this invention, provided they are capable of releasing sufficient aerosol forming vapors to satisfactorily resemble tobacco smoke.

Thermally stable materials which may be used as the carrier or substrate for the aerosol forming substance are well known to those skilled in the art. Useful carriers should be porous, and must be capable of retaining an aerosol forming compound and releasing a potential aerosol forming vapor upon heating by the fuel. Useful thermally stable materials include adsorbent carbons, such as porous grade carbons, graphite, activated, or non-activated carbons, and the like, such as PC-25 and PG-60 available from Union Carbide Corp., Danbury, Conn., as well as SGL carbon, available from Calgon. Other suitable materials include inorganic solids, such as ceramics, glass, alumina, vermiculite, clays such as bentonite, mixtures of such materials, and the like. Carbon and alumina substrates are preferred.

An especially useful alumina substrate is a high surface area alumina (about 280 $m^2/g$), such as the grade available from the Davison Chemical Division of W. R. Grace & Co. under the designation SMR-14-1896. This alumina (−14 to +20 U.S. mesh) is treated to make it suitable for use in the articles of the present invention by sintering for about one hour at an elevated temperature, e.g., greater than 1000° C., preferably from about 1400° to 1550° C., followed by appropriate washing and drying.

It has been found that suitable particulate substrates also may be formed from carbon, tobacco, or mixtures of carbon and tobacco, into densified particles in a one-step process using a machine made by Fuji Paudal KK of Japan, and sold under the trade name of "Marumerizer." This apparatus is described in U.S. Pat. Re. No. 27,214.

The non-tobacco non-aqueous aerosol forming substance or substances used in the articles of the present invention must be capable of forming an aerosol at the temperatures present in the aerosol generating means upon heating by the burning fuel element. Such substances preferably will be composed of carbon, hydrogen and oxygen, but they may include other materials. Such substances can be in solid, semi-solid, or liquid form. The boiling or sublimation point of the substance and/or the mixture of substances can range up to about 500° C. Substances having these characteristics include: polyhydric alcohols, such as glycerin, triethylene glycol, and propylene glycol, as well as aliphatic esters of mono-, di-, or poly-carboxylic acids, such as methyl stearate, dimethyl dodecandioate, dimethyl tetradecandioate, and others.

The preferred aerosol forming substances are polyhydric alcohols, or mixtures of polyhydric alcohols. More preferred aerosol formers are selected from glycerin, triethylene glycol and propylene glycol.

When a substrate material is employed as a carrier, the aerosol forming substance may be dispersed on or within the substrate in a concentration sufficient to permeate or coat the material, by any known technique. For example, the aerosol forming substance may be applied full strength or in a dilute solution by dipping, spraying, vapor deposition, or similar techniques. Solid aerosol forming components may be admixed with the substrate material and distributed evenly throughout prior to formation of the final substrate.

While the loading of the aerosol forming substance will vary from carrier to carrier and from aerosol forming substance- to aerosol forming substance, the amount of non-tobacco non-aqueous aerosol forming substances may generally vary from about 20 mg to about 140 mg, and preferably from about 40 mg to about 110 mg. As much as possible of the aerosol former carried on the substrate should be delivered to the user as WTPM. Preferably, above about 2 weight percent, more preferably above about 15 weight percent, and most preferably above about 20 weight percent of the aerosol former carried on the substrate is delivered to the user as WTPM.

The aerosol generating means also may include one or more volatile flavoring agents, such as menthol, vanillin, artificial coffee, tobacco extracts, nicotine, caffeine, liquors, and other agents which impart flavor to the aerosol. It also may include any other desirable volatile solid or liquid materials. Alternatively, these optional agents may be placed between the aerosol generating means and the mouth end, such as in a separate substrate or chamber or coated within the passageway leading to the mouth end, or in the optional tobacco charge.

One particularly preferred aerosol generating means comprises the aforesaid alumina substrate containing tobacco extract, tobacco flavor modifiers, such as levulinic acid or glucose pentaacetate, one or more flavoring agents, and an aerosol forming agent, such as glycerin.

A charge of tobacco may be employed downstream from the fuel element and from the non-aqueous non-tobacco aerosol forming substances. In such cases, hot vapors are swept through the tobacco to extract and distill the volatile components from the tobacco, without combustion or substantial pyrolysis. Thus, the user receives an aerosol which contains the tastes and flavors of natural tobacco without the numerous combustion products produced by a conventional cigarette.

Articles of the type disclosed herein may be used or may be modified for use as drug delivery articles, for delivery of volatile pharmacologically or physiologically active materials such as ephedrine, metaproterenol, terbutaline, or the like.

The heat conducting member preferably employed in practicing this invention is typically a metallic tube or foil, such as deep drawn aluminum, varying in thickness from less than about 0.01 mm to about 0.1 mm, or more. The thickness and/or the type of conducting material may be varied (e.g., Grafoil, from Union Carbide) to achieve virtually any desired degree of heat transfer.

As shown in the illustrated embodiment, the heat conducting member preferably contacts or overlaps the rear portion of the fuel element, and may form the container which encloses the aerosol forming substance. Preferably, the heat conducting member extends over no more than about one-half the length of the fuel element. More preferably, the heat conducting member overlaps or otherwise contacts no more than about the rear 5 mm, preferably 2–3 mm, of the fuel element. Preferred recessed members of this type do not interfere with the lighting or burning characteristics of the fuel element. Such members help to extinguish the fuel element when it has been consumed to the point of contact with the conducting member by acting as a heat sink. These members also do not protrude from the lighting end of the article even after the fuel element has been consumed.

The insulating members employed in practicing the invention are preferably formed into a resilient jacket from one or more layers of an insulating material. Advantageously, this jacket is at least about 0.5 mm thick, preferably at least about 1 mm thick, and preferably from about 1.5 to 2.0 mm thick. Preferably, the jacket extends over more than about half of the length of the fuel element. More preferably, it also extends over substantially the entire outer periphery of the fuel element and the capsule for the aerosol generating means. As shown in the embodiment of FIG. 1, different materials may be used to insulate these two components of the article.

Insulating members which may be used in accordance with the present invention generally comprise inorganic or organic fibers such as those made out of glass, alumina, silica, vitreous materials, mineral wool, carbons, silicons, boron, organic polymers, cellulosics, and the like, including mixtures of these materials. Non-fibrous insulating materials, such as silica aerogel, perlite, glass, and the like may also be used. Preferred insulating members are resilient, to help simulate the feel of a conventional cigarette. Preferred insulating materials generally do not burn during use. However, slow burning materials and especially materials which fuse during heating, such as low temperature grades of glass fibers, may be used. These materials act primarily as an insulating jacket, retaining and directing a significant portion of the heat formed by the burning fuel element to the aerosol generating means. Because the insulating jacket becomes hot adjacent to the burning fuel element, to a limited extent, it also may conduct heat toward the aerosol generating means.

The currently preferred insulating fibers are ceramic fibers, such as glass fibers. Two preferred glass fibers are experimental materials produced by Owens—Corning of Toledo, Ohio under the designations 6432 and 6437. Other such suitable glass fibers are available from the Manning Paper Company of Troy, N.Y., under the designations, Manniglas 1000 and Manniglas 1200. When possible, glass fiber materials having a low softening point, e.g., below about 650° C., are preferred.

Several commercially available inorganic insulating fibers are prepared with a binder e.g., PVA, which acts to maintain structural integrity during handling. These binders, which would exhibit a harsh aroma upon heating, should be removed, e.g., by heating in air at about 650° C. for up to about 15 min. before use herein. If desired, pectin, at up to about 3 weight percent, may be added to the fibers to provide mechanical strength to the jacket without contributing harsh aromas.

In many embodiments of the invention, the fuel and aerosol generating means will be attached to a mouthend piece, although a mouthend piece may be provided separately, e.g., in the form of a cigarette holder. This element of the article provides the enclosure which channels the vaporized aerosol forming substance into the mouth of the user. Due to its length, about 35 to 50 mm, it also keeps the heat fire cone away from the mouth and fingers of the user, and provides sufficient time for the hot aerosol to form and cool before reaching the user.

Suitable mouthend pieces should be inert with respect to the aerosol forming substances, should offer minimum aerosol loss by condensation or filtration, and should be capable of withstanding the temperature at the interface with the other elements of the article. Preferred mouthend pieces include the cellulose acetate—polypropylene scrim combination illustrated in the embodiments of FIG. 1 and the mouthend pieces disclosed in Sensabaugh et al., European Patent Publication No. 174,645.

The entire length of the article or any portion thereof may be overwrapped with cigarette paper. Preferred papers at the fuel element end should not openly flame during burning of the fuel element. In addition, the paper preferably has controllable smolder properties and produces a grey, cigarette-like ash.

In those embodiments utilizing an insulating jacket wherein the paper burns away from the jacketed fuel element, maximum heat transfer is achieved because air flow to the fuel element is not restricted. However, papers can be designed to remain wholly or partially intact upon exposure to heat from the burning fuel element. Such papers provide the opportunity to restrict air flow to the burning fuel element, thereby controlling the temperature at which the fuel element burns and the subsequent heat transfer to the aerosol generating means.

To reduce the burning rate and temperature of the fuel element, thereby maintaining a low $CO/CO_2$ ratio, a non-porous or zero-porosity paper treated to be slightly porous, e.g., noncombustible mica paper with a plurality of holes therein, may be employed as the overwrap layer. Such a paper aids in providing more consistant heat delivery, especially in the middle puffs (i.e., 4–6).

To maximize aerosol delivery, which otherwise would be diluted by radial (i.e., outside) air infiltration through the article, a non-porous paper may be used from the aerosol generating means to the mouth end.

Papers such as these are known in the cigarette and/or paper arts and mixtures of such papers may be employed for various functional effects. Preferred papers used in the articles of the present invention include RJR Archer's 8-0560-36 Tipping with Lip Release paper, Ecusta's 646 Plug Wrap and ECUSTA 01788 manufactured by Ecusta of Pisgah Forest, N.C., and Kimberly-Clark's P868-16-2 and P878-63-5 papers.

The aerosol produced by the preferred articles of the present invention is chemically simple, consisting essentially of air, oxides of carbon, aerosol former including any desired flavors or other desired volatile materials, water and trace amounts of other materials. The WTPM produced by the preferred articles of this invention has no mutagenic activity as measured by the Ames test, i.e., there is no significant dose response relationship between the WTPM produced by preferred articles of the present invention and the number of revertants occurring in standard test microorganisms exposed to such products. According to the proponents of the Ames test, a significant dose dependent response indicates the presence of mutagenic materials in the products tested. See Ames et al., *Mut. Res.*, 31: 347–364 (1975); Nagao et al., *Mut. Res.* 42: 335 (1977).

A further benefit from the preferred embodiments of the present invention is the relative lack of ash produced during use in comparison to ash from a conventional cigarette. As the preferred carbon fuel element is burned, it is essentially converted to oxides of carbon, with relatively little ash generation, and thus there is no need to dispose of ashes while using the article.

The fuel elements and smoking articles of the present invention will be further illustrated with reference to the following examples which aid in the understanding of the present invention, but which are not to be construed as limitations thereof. All percentages reported herein, unless otherwise specified, are percent by weight. All temperatures are expressed in degrees Celsius. In all examples, the articles have a maximum cross-sectional dimension (diameter) of about 7 to 8 mm, the diameter of a conventional cigarette.

EXAMPLE 1

The fuel elements of the present invention (each having a density of about 0.86 g/cc) were prepared from an extruded mixture of carbon, SCMC binder and potassium carbonate ($K_2CO_3$) as follows:

The carbon was prepared by carbonizing a non-talc containing grade of Grand Prairie Canadian Kraft hardwood paper under a nitrogen blanket, at a step-wise increasing temperature rate of about 10° C. per hour to a final carbonizing temperature of 750° C.

After cooling under nitrogen to less than about 35° C., the carbon was ground to a mesh size of minus 200. The powdered carbon was then heated under nitrogen to a temperature of about 850° C. to remove volatiles.

After cooling under nitrogen to less than about 35° C., the carbon was ground to a fine powder, i.e., a powder having an average particle size of from about 0.1 to 50 microns.

This fine powder was admixed with Hercules 7HF SCMC binder (9 parts carbon: 1 part binder), 1 wt. percent $K_2CO_3$, and sufficient water to make a stiff, dough-like paste.

Fuel elements were extruded from this paste having the peripheral passageway configurations substantially as depicted in FIGS. 2–10. The individual fuel elements were then cut to length from the extrudate and dried. Detailed information concerning selected individual fuel elements are provided in the examples which follow.

The fuel element depicted in FIG. 9 was prepared substantially as set forth above. The seven large central holes were each about 0.021 in. in diameter and the six peripheral holes were each about 0.010 in. in diameter. The web thickness between the inner holes was about 0.008 in. and the average outer web thickness These most preferred fuel elements (10 mm×4.48 mm) were baked-out under a nitrogen atmosphere at 900° C. for three hours after formation.

Preferred cigarette-type smoking articles of the type substantially as illustrated in FIG. 1 were prepared in the following manner:

The capsule used to construct the FIG. 1 smoking article was prepared from deep drawn aluminum. The capsule had an average wall thickness of about 0.004 in. (0.01 mm), and was about 30 mm in length, having an inner diameter of about 4.5 mm. The rear of the container was sealed with the exception of two slit-like openings (each about 0.65×3.45 mm, spaced about 1.14 mm apart) to allow passage of the aerosol former to the user.

The substrate material for the aerosol generating means was W. R. Grace's SMR14-896 high surface area alumina (surface area=280 $m^2/g$), having a mesh size of from −14, +20 (U.S.). Before use herein, this alumina was sintered for about 1 hour at a soak temperature which ranged from about 1450° to 1550° C. After cooling, this alumina was washed with water and dried.

This sintered alumina was combined, in a two step process, with the ingredients shown in Table I, in the indicated proportions:

TABLE I

| | |
|---|---|
| Alumina | 67.7% |
| Glycerin | 19.0% |
| Spray Dried Extract | 8.5% |
| Flavoring Mixture | 4.2% |
| Glucose pentaacetate | 0.6% |
| Total: | 100.0% |

The spray dried extract is the dry powder residue resulting from the evaporation of an aqueous tobacco extract solution. It contains water soluble tobacco components. The flavoring mixture is a mixture of flavor compounds which simulates the taste of cigarette smoke. One flavoring material used herein was obtained from Firmenich of Geneva, Switzerland under the designation T69-22.

In the first step, the spray dried tobacco extract was mixed with sufficient water to form a slurry. This slurry was then applied to the alumina substrate by mixing until the slurry was uniformly absorbed (or adsorbed) by the alumina. The treated alumina was then dried to a moisture content of about 1 wt. percent. In the second step, this treated alumina was mixed with a combination of the other listed ingredients until the liquid was uniformly adsorbed (or absorbed) by the alumina. The capsule was filled with about 325 mg of this substrate material.

A fuel element prepared as above, was inserted into the open end of the filled capsule to a depth of about 3 mm. The fuel element capsule combination was overwrapped at the fuel element end with a 10 mm long, glass fiber jacket of Owens-Corning 6437 (having a softening point of about 650° C.), with 3 wt. percent pectin binder, to a diameter of about 7.5 mm. The glass fiber jacket was then overwrapped with Kimberly-Clark's P878-63-5 paper.

A 7.5 mm diameter tobacco rod (28 mm long) with an overwrap of Ecusta 646 plug wrap was modified to have a longitudinal passageway (about 4.5 mm diameter) therein. The jacketed fuel element capsule combination was inserted into the tobacco rod passageway until the glass fiber jacket abutted the tobacco. The jacketed sections were joined together by Kimberly-Clark's P850-208 paper a process scale version of their P878-16-2 paper).

A mouthend piece of the type illustrated in FIG. 1, was constructed by combining two sections; (1) a hollow cylinder of cellulose acetate (10 mm long/7.5 mm outer diameter/4.5 mm inner diameter) overwrapped with 646 plug wrap; and (2) a section of non-woven polypropylene scrim, rolled into a 30 mm long, 7.5 mm diameter cylinder overwrapped with Kimberly-Clark's P850-186-2 paper; with a combining overwrap of Kimberly-Clark's P850-186-2 paper.

The combined mouthend piece section was joined to the jacketed fuel element - capsule section by a final overwrap of RJR Archer Inc. 8-0560-36 tipping with lip release paper.

FIG. 1 type smoking articles were prepared using the FIG. 9 type fuel elements and these articles were tested for carbon monoxide delivery by subjecting these articles to FTC smoking conditions, and measuring the CO production (using a Beckmann Instruments Co. Model 864 Non-dispersive IR Analyzer). Smoking articles tested in this manner delivered an average of about 13.5 mg CO over 10 puffs, and were easy to ignite. Aerosol delivery was satisfactory over the entire puff count.

In contrast, a FIG. 9 type fuel element (10 mm×4.5 mm), without the six peripheral holes, baked-out at only 850° C., when used in the smoking article of FIG. 1, delivered an average of about 13.1 mg CO over 10 puffs under FTC smoking conditions, but was very difficult to ignite.

EXAMPLE 2

The fuel elements depicted in FIGS. 2 and 3 were prepared substantially as set forth in Example 1 but were not baked out after formation. The passageway configurations illustrated were formed as set forth in Example 1 during the extrusion of the carbon/SCMC paste.

Fuel elements (10 mm×4.5 mm) having the passageway configuration substantially as illustrated in FIG. 2 had the following dimensions: depth of channel—about 0.030 in., width of channel—about 0.016 in.; width of carbon ridge separating adjacent channels—about 0.021 in.

Fuel elements (10 mm×4.5 mm) having the passageway configuration substantially as illustrated in FIG. 3 had the following dimensions: depth of channel—about 0.030 in., width of channel—about 0.016 in.; width of carbon ridge separating adjacent channels —about 0.021 in.; width of carbon ridge separating the pair of adjacent channels—about 0.042 in.

Smoking articles were prepared as in Example 1 using the FIG. 2 and/or 3 type fuel elements.

These smoking articles were smoked under mechanical smoking conditions of 50 ml puff volumes of 2 seconds duration, with a puff frequency of 30 seconds. Under these conditions, the average puff count for both fuel element types was about 15. Aerosol delivery (both early and overall) for articles employing the depicted fuel elements was good.

Using FTC smoking conditions (35 ml puff volumes of 2 sec. duration, 60 second puff frequency) smoking articles employing these fuel element types were tested as in Example 1 for carbon monoxide delivery. For an average of about 10 puffs under FTC smoking conditions, smoking articles utilizing fuel elements having the peripheral passageway configurations illustrated in FIGS. 2 and 3, produced about 8 mg CO.

EXAMPLE 3

The fuel element type depicted in FIG. 4 was prepared substantially as set forth in Example 2 but were not baked out after formation.

The passageway configuration illustrated was formed during the extrusion of the carbon/SCMC paste. The dimensions of the channels were substantially the same as those specified for the fuel element of FIG. 2 in Example 2. The dimensions of the central passageway were about 0.06 in.×0.01 in. and 0.03 in.×0.01 in.

Smoking articles employing the fuel elements (6.5 mm×4.5 mm) having this passageway configuration were tested under the conditions described in Example 2 for aerosol delivery. These smoking articles were substantially identical to those described in Example 1 except that the aerosol chamber employed was only about 23 mm long. Aerosol delivery over about 14 (50 ml volume) puffs was good.

Smoking articles employing fuel elements having this passageway configuration were tested for carbon monoxide delivery as set forth in Example 1. Over about 10 puffs under FTC smoking conditions, the CO delivery was about 10 mg.

EXAMPLE 4

The fuel element depicted in FIG. 5 was prepared substantially as set forth in Example 1 but were not baked out after formation. The passageway configuration illustrated was formed during the extrusion of the carbon/SCMC paste. The width of each ridge was about 0.021 in. and the width of each channel was about 0.021 in. The depth of each channel was about 0.030 in.

Smoking articles of Example 1 employing 10 mm×4.5 mm fuel elements having this type of passageway configuration were tested for aerosol and carbon monoxide delivery as in the previous examples. Aerosol delivery for about 15 (50 ml volume) puffs was good. CO delivery over about 10 puffs under FTC smoking conditions was about 9 mg.

EXAMPLE 5

The fuel element depicted in FIG. 6 was prepared substantially as set forth in Example 1. The passageway configuration illustrated was formed after the extrusion, cutting and drying of the carbon/SCMC paste, by hand drilling. The diameter of the holes was about 0.025 in. The outer web thickness was about 0.005 in. The inner web thickness was about 0.004 in. The overall dimensions of the fuel element were 10 mm×4.5 mm.

Smoking articles of Example 1 employing fuel elements having this passageway configuration were tested for carbon monoxide delivery as in the previous examples. These fuel elements delivered an average of about 7.5 mg CO over 11 puffs under FTC smoking conditions.

EXAMPLE 6

The fuel element depicted in FIG. 7 was prepared substantially as set forth in Example 1 but were not baked out after formation. The hole configuration illustrated was formed after the extrusion, drying and cutting of the carbon/SCMC paste, by hand drilling. The diameter of each of the holes was about 0.025 in. Both the inner and the outer web thickness were about 0.025 in.

Fuel elements having this passageway configuration were tested for carbon monoxide delivery by preparing smoking articles as set forth in Example 1, and subjecting these articles to FTC smoking conditions, and measuring the CO production.

Fuel elements (10 mm×4.5 mm) having the configuration substantially as illustrated in FIG. 7 delivered an average of about 8 mg CO over 9 puffs under FTC smoking conditions.

EXAMPLE 7

The fuel element depicted in FIG. 8 was prepared substantially as set forth in Example 1 but were not baked out after formation. The passageway configuration illustrated was formed after the extrusion of the carbon/SCMC paste. The hole diameter was about 0.037 in., the outer web thickness was about 0.009 in. and the inner web thickness was about 0.002 in.

Smoking articles of Example 1 employing 10 mm×4.5 mm fuel elements having this passageway configuration were tested for carbon monoxide delivery by subjecting these articles to FTC smoking conditions, and measuring the CO production. These smoking articles delivered an average of about 8.6 mg CO over 11 puffs under FTC smoking conditions.

EXAMPLE 8

The fuel element depicted in FIG. 10 was prepared substantially as set forth in Example 1. The passageway configuration illustrated was formed during the extrusion of the carbon/SCMC paste. The three large central holes were each about 0.021 in. in diameter and the twelve peripheral holes were each about 0.010 in. in diameter. The web thickness between the inner holes was about 0.008 in. and the average outer web thickness was about 0.020 in.

In addition, fuel elements having this hole configuration (10 mm×4.47 mm) were baked-out at 950° C. for three hours after formation.

Smoking articles of Example 1 were prepared using fuel elements having this passageway configuration and these articles were tested for carbon monoxide delivery by subjecting these articles to FTC smoking conditions, and measuring the CO production. Smoking articles tested in this manner delivered an average of about 11.9 mg CO over 10 puffs under FTC smoking conditions. In addition, the fuel elements ignited readily, without any noticeable difficulty.

EXAMPLE 9

The fuel element depicted in FIG. 11 was prepared substantially as set forth in Example 1 but were not baked out after formation. The passageway configuration illustrated was formed during the extrusion of the carbon/SCMC paste. The three central holes were each about 0.1×0.020 in. and the spacing between the holes was about 0.012 in. Three equally spaced channels (120° apart) were cut into the periphery of the fuel element, each about 0.020 in. deep and about 0.020 in. wide.

Smoking articles of Example 1 were prepared using fuel elements (5.3 mm long and 6.0 mm in diameter) having this passageway configuration and these articles were tested for carbon monoxide delivery by subjecting these articles to FTC smoking conditions, and measuring the CO production. Smoking articles tested in this manner delivered an average of about 8 mg CO over 10 puffs under FTC smoking conditions.

The present invention has been described in detail, including the preferred embodiments thereof. However, it will be appreciated that those skilled in the art, upon consideration of the present disclosure, may make modifications and/or improvements on this invention and still be within the scope and spirit of this invention a set forth in the following claims.

What is claimed is:

1. A smoking article comprising:

(a) a carbonaceous fuel element, said fuel element having a plurality of peripheral longitudinal passageways selected from (1) channels open on the periphery of the fuel element and (2) closed passageways situated sufficiently near the periphery of the fuel element whereby said passageways burn out to the periphery to form open channels during use; and (b) an aerosol generating means including an aerosol forming material.

2. The smoking article of claim 1, wherein at least one of the peripheral passageways of the fuel element is a channel.

3. The smoking article of claim 1, wherein at least one of the peripheral passageways of the fuel element is a hole situated proximate to the periphery of the fuel element.

4. The smoking article of claim 1, 2 or 3, wherein the fuel element has at least four peripheral passageways.

5. The smoking article of claim 1, 2 or 3, wherein the fuel element also has at least one centrally located, longitudinally extending passageway.

6. The smoking article of claim 5, wherein the fuel element has a plurality of centrally located, longitudinally extending passageways.

7. The smoking article of claim 6, wherein the fuel element has at least three centrally located, longitudinally extending passageways.

8. The smoking article of claim 6, wherein at least two of the centrally located, longitudinally extending passageways coalesce during the burning of the fuel element.

9. The smoking article of claim 1, 2, or 3, wherein at least two of the peripheral passageways coalesce during the burning of the fuel element.

10. The smoking article of claim 1, 2, or 3, which further comprises a heat conducting member surrounding a portion of the rear periphery of the fuel element.

11. The smoking article of claim 1, 2 or 3, which further comprises an insulating member surrounding a portion of the fuel element.

12. The smoking article of claim 1, 2 or 3, wherein the fuel element is less than about 30 mm in length prior to smoking.

13. The smoking article of claim 1, 2 or 3, wherein the fuel element is about 20 mm or less, in length prior to smoking.

14. The smoking article of claim 13, wherein the fuel element has a diameter of less than about 8 mm.

15. The smoking article of claim 1, 2 or 3, wherein the fuel element is about 10 mm or less, in length prior to smoking.

16. The smoking article of claim 15, wherein the fuel element has a diameter of less than about 6 mm.

17. The smoking article of claim 1, 2 or 3, wherein the smoking article is a cigarette-type smoking article.

18. The smoking article of claim 17, wherein the article delivers about 13 mg CO or less, over ten 35 ml puffs of two seconds duration, each puff separated by 58 seconds of smolder.

19. The smoking article of claim 17, wherein the article delivers about 9 mg CO or less, over ten 35 ml puffs of two seconds duration, each puff separated by 58 seconds of smolder.

20. The smoking article of claim 17, wherein the article delivers about 7 mg CO or less, over ten 35 ml puffs of two seconds duration, each puff separated by 58 seconds of smolder.

21. A cigarette-type smoking article comprising:

(a) a combustible fuel element less than about 30 mm in length prior to smoking having a plurality of pheripheral longitudinal passageways selected from (1) channels open on the periphery of the fuel element and (2) closed passageways situated sufficiently hear the periphery of the fuel element whereby said passageways burn out to the periphery to form open channels during use; and (b) a physically separate aerosol generating means including an aerosol forming material.

22. The smoking article of claim 21, wherein at least one of the peripheral passageways is a channel.

23. The smoking article of claim 21, wherein at least one of the peripheral passageways is a hole situated proximate to the periphery of the fuel element.

24. The smoking article of claim 19, 20, 21, or 22, wherein at least two of the peripheral passageways coalesce during the burning of the fuel element.

25. The smoking article of claim 19, 20, 21, or 22, wherein the fuel element also has at least one centrally located, longitudinally extending passageway.

26. The smoking article of claim 23, wherein the fuel element has a plurality of centrally located, longitudinally extending passageways.

27. The smoking article of claim 26, wherein the fuel element has at least three centrally located, longitudinally extending passageways.

28. The smoking article of claim 26, wherein at least two of the centrally located, longitudinally extending passageways coalesce during the burning of the fuel element.

29. The smoking article of claim 21, 22, or 23, wherein at least two of the peripheral passageways coalesce during the burning of the fuel element.

30. The smoking article of claim 21, 22 or 23, which further comprises a heat conducting member surrounding a portion of the rear periphery of the fuel element.

31. The smoking article of claim 22, 22 or 23, which further comprises an insulating member surrounding a portion of the fuel element.

32. The smoking article of claim 21, 22 or 23, wherein the fuel element is less than about 20 mm in length and has a density of at least about 0.7 g/cc.

33. The smoking article of claim 32, wherein the fuel element has a diameter of less than about 8 mm.

34. The smoking article of claim 21, 22 or 23, wherein the fuel element is about 10 mm or less in length and has a density of at least about 0.85 g/cc.

35. The smoking article of claim 21, 22 or 23, wherein the fuel element and the aerosol generating means are in a conductive heat exchange relationship.

36. A cigarette-type smoking article comprising:

(a) a fuel element less than 30 mm in length prior to smoking having a plurality of peripheral longitudinal passageways selected from (1) open channels on the periphery of the fuel element and (2) closed passageways situated sufficiently near the periphery of the fuel element whereby said passageways burn out to the periphery to form open channels during use;

(b) a physically separate aerosol generating means including a carrier bearing an aerosol forming material;

(c) means for conducting heat from the fuel element to the aerosol generating means; and (d) an insulating member which surrounds at least a portion of the fuel element.

37. The smoking article of claim 36, wherein the fuel element is carbonaceous.

38. The smoking article of claim 36 or 37, wherein the fuel element is less than about 15 mm in length.

39. The smoking article of claim 36 or 37, wherein at least one of the peripheral passageways is a channel.

40. The smoking article of claim 36 or 37, wherein at least one of the peripheral passageways is a hole situated proximate to the peripheral edge of the fuel element.

41. The smoking article of claim 36 or 37, wherein the fuel element has at least four peripheral passageways.

42. The smoking article of claim 36 or 37, wherein the fuel element also has at least one centrally located, longitudinally extending passageway.

43. The smoking article of claim 42, wherein the fuel element has a plurality of centrally located, longitudinally extending passageways.

44. The smoking article of claim 43, wherein the fuel element has at least three centrally located, longitudinally extending passageways.

45. The smoking article of claim 43, wherein at least two of the centrally located, longitudinally extending passageways coalesce during the burning of the fuel element.

46. The smoking article of claim 36 or 37, wherein at least two of the peripheral passageways coalesce during the burning of the fuel element.

47. The smoking article of claim 36 or 37, which further comprises a heat conducting member surrounding a portion of the rear periphery of the fuel element.

48. The smoking article of claim 36 or 37, which further comprises an insulating member surrounding a portion of the fuel element.

49. A fuel element for a smoking article, said fuel element being carbonaceous and having a plurality of peripheral longitudinal passageways, the passageways being selected from (1) open channels on the periphery of the fuel element and (2) closed passageways situated sufficiently near the periphery of the fuel element whereby said passageways burn out to the periphery to form open channels during use.

50. The carbonaceous fuel element of claim 49, wherein at least one of the peripheral passageways is a channel.

51. The carbonaceous fuel element of claim 49, wherein at least one of the peripheral passageways is a hole situated proximate to the periphery thereof.

52. The carbonaceous fuel element of claim 50 or 51, which has at least four peripheral passageways.

53. The carbonaceous fuel element of claim 50 or 51, which also has at least one centrally located, longitudinally extending passageway.

54. The carbonaceous fuel element of claim 53, which has a plurality of centrally located, longitudinally extending passageways.

55. The carbonaceous fuel element of claim 54, which has at least three centrally located, longitudinally extending passageways.

56. The carbonaceous fuel element of claim 55, wherein at least two of the centrally located, longitudinally extending passageways coalesce during the burning of the fuel element.

57. The carbonaceous fuel element of claim 50 or 51, wherein at least two of the peripheral passageways coalesce during the burning of the fuel element.

58. The carbonaceous fuel element of claim 50 or 51, which is less than about 30 mm in length prior to smoking.

59. The carbonaceous fuel element of claim 49, 50, 51, which is about 20 mm or less in length prior to smoking.

60. The carbonaceous fuel element of claim 59, which has a diameter of less than about 8 mm.

61. The carbonaceous fuel element of claim 50 or 51, which is about 10 mm or less in length prior to smoking.

62. The carbonaceous fuel element of claim 61, which has a diameter of less than about 6 mm.

63. The carbonaceous fuel element of claim 50 or 51, which has a maximum cross - sectional dimension of from about 3 to 8 mm.

64. The carbonaceous fuel element of claim 63, which has a maximum cross-sectional dimension of from about 4 to 6 mm.

65. The carbonaceous fuel element of claim 49, 50, 51, or 56 which is formed from a mixture comprising carbon and a binder, wherein the formed fuel element is pyrolyzed in a non-oxidizing atmosphere to convert at least a portion of the binder to carbon.

66. The fuel element of claim 65, wherein the pyrolysis is conducted at a temperature range of from about 750° C. to 1150° C.

67. The fuel element of claim 65, wherein the pyrolysis is conducted at a temperature range of from about 850° C. to 950° C.

68. A smoking article comprising:

(a) a carbonaceous fuel element, said fuel element having a plurality of peripheral longitudinal passageways and a plurality of centrally located, longitudinally extending passageways; and (b) an aerosol generating means including an aerosol forming material.

69. A cigarette-type smoking article comprising:

(a) a combustible fuel element less than about 30 mm in length prior to smoking having a plurality of peripheral longitudinal passageways and a plurality of centrally located, longitudinally extending passageways; and (b) a physically separate aerosol generating means including an aerosol forming material.

70. A cigarette-type smoking article comprising:

(a) a fuel element less than 30 mm in length prior to smoking having a plurality of peripheral longitudinal passageway and a plurality of centrally located longitudinally extending passageways;

(b) a physically separate aerosol generating means including a carrier bearing an aerosol forming material;

(c) means for conducting heat from the fuel element to the aerosol generating means; and (d) an insulating member which surrounds at least a portion of the fuel element.

71. The smoking article of claim 68, 69, or 70, wherein the fuel element has at least three centrally located, longitudinally extending passageways.

72. The smoking article of claim 68, 69, or 70, wherein at least two of the centrally located, longitudinally extending passageways coalesce during burning of the fuel element.

73. The smoking article of claim 68, 69, or 70, further comprising a heat conducting member surrounding a portion of the rear periphery of the fuel element.

74. The smoking article of claim 68, 69, or 70, wherein the fuel element is about 20 mm or less prior to smoking.

75. A fuel element for a smoking article, said fuel element being carbonaceous and having a plurality of peripheral longitudinal passageways and a plurality of centrally located, longitudinally extending passageways.

76. The fuel element of claim 75, wherein at least two of the centrally located, longitudinally extending passageways coalesce during burning of the fuel element.

77. The smoking article of claim 68, 69, or 70, wherein the fuel element is less than about 30 mm prior to smoking.

78. A smoking article comprising:

(a) a carbonaceous fuel element, said fuel element comprising a plurality of open channels on the periphery of the fuel element; and (b) an aerosol generating means including an aerosol forming material.

79. The smoking article of claim 78, wherein the fuel element further comprises at least one centrally located, longitudinally extending passageway.

80. The smoking article of claim 78 or 79, wherein the fuel element has at least six open channels on its periphery.

81. A smoking article comprising:

(a) a carbonaceous fuel element, said fuel element comprising six open channels on the periphery of the fuel element and one centrally located, longitudinally extending passageway through the fuel element; and (b) an aerosol generating means including an aerosol forming material.

82. A fuel element for a smoking article, said fuel element being carbonaceous and having a plurality of open peripheral channels, and at least one centrally located, longitudinally extending passageway.

83. The fuel element of claim 82, wherein the fuel element has at least six open channels on its periphery.

84. The fuel element of claim 82, wherein the fuel element is at least about 80 percent carbon by weight.

85. The fuel element of claim 82, wherein the fuel element is at least about 90 percent carbon by weight.

* * * * *

UNITED STATES PATENT AND TRADEMARK OFFICE

CERTIFICATE OF CORRECTION

PATENT NO. : 4,989,619

DATED : February 5, 1991

INVENTOR(S) : Jack F. Clearman et al.

It is certified that error appears in the above—identified patent and that said Letters Patent is hereby corrected as shown below:

Col. 3, line 12, "silimar" should be --similar--.

Col. 20, line 13, after "thickness" insert --was 0.019 in.--.

Col. 24, line 19, "a" should be --as--.

Col. 25, line 28, "hear" should be --near--.

Col. 25, line 61, "22" first occurrence should be --21--.

Signed and Sealed this

Eighth Day of September, 1992

*Attest:*

DOUGLAS B. COMER

*Attesting Officer*

*Acting Commissioner of Patents and Trademarks*